US006785986B1

(12) United States Patent
Brand et al.

(10) Patent No.: US 6,785,986 B1
(45) Date of Patent: Sep. 7, 2004

(54) SHOE AND SOLE FITTED WITH TORSION STIFFENER

(75) Inventors: Johanna Louise Brand, Rockanje (NL); Cornelis Dirk Jongenengel, Poortugaal (NL)

(73) Assignee: C.D. Johgenengel Beheer BV (NL)

( * ) Notice: Subject to any disclaimer, the term of this patent is extended or adjusted under 35 U.S.C. 154(b) by 0 days.

(21) Appl. No.: 10/048,818

(22) PCT Filed: Aug. 1, 2000

(86) PCT No.: PCT/NL00/00552

§ 371 (c)(1),
(2), (4) Date: May 6, 2002

(87) PCT Pub. No.: WO01/08524

PCT Pub. Date: Feb. 8, 2001

(30) Foreign Application Priority Data

Aug. 3, 1999 (NL) ..... 1012770

(51) Int. Cl.[7] ..... A43B 13/42; A43B 23/22

(52) U.S. Cl. ..... 36/76 R; 36/107; 36/25 R; 36/144

(58) Field of Search ..... 36/27, 30 R, 25 R, 36/107, 108, 88, 140, 142, 143, 144, 76 R, 76 C

(56) References Cited

U.S. PATENT DOCUMENTS

| | | | | | |
|---|---|---|---|---|---|
| 1,484,785 | A | * | 2/1924 | His | 36/76 R |
| 1,806,409 | A | * | 5/1931 | Nickerson | 36/145 |
| 2,034,243 | A | * | 3/1936 | Maxwell | 36/108 |
| 2,044,319 | A | | 6/1936 | Newberry | |
| 2,097,759 | A | | 11/1937 | Ehrlich | |
| 2,103,627 | A | | 12/1937 | Mirenta | |
| 2,126,913 | A | * | 8/1938 | Musebeck | 36/182 |
| 2,216,630 | A | * | 10/1940 | Sabel et al. | 36/143 |
| 2,266,369 | A | * | 12/1941 | Kohn | 12/133 R |
| 2,345,820 | A | * | 4/1944 | Kohn | 36/144 |
| 3,550,597 | A | * | 12/1970 | Coplans | 36/144 |
| 3,841,005 | A | | 10/1974 | Cox | |
| 4,922,631 | A | | 5/1990 | Anderié | |
| 5,452,526 | A | | 9/1995 | Collins | |
| 5,720,117 | A | | 2/1998 | Toschi | |
| 5,845,420 | A | | 12/1998 | Buccianti et al. | |

FOREIGN PATENT DOCUMENTS

| | | |
|---|---|---|
| DE | 28 06 481 | 8/1979 |
| EP | 0 471 447 | 2/1992 |
| FR | 2 310 718 | 12/1976 |
| GB | 504 990 | 5/1939 |
| GB | 533 437 | 2/1941 |
| GB | 599 832 A | 3/1948 |
| WO | WO 91 11156 | 8/1991 |

* cited by examiner

*Primary Examiner*—M. D. Patterson
(74) *Attorney, Agent, or Firm*—Swanson & Bratschun LLC

(57) ABSTRACT

A shoe comprising a sole having a supporting surface for supporting a foot and an upper connected with the sole for locking a foot onto the supporting surface. The sole comprises an elongated torsion stiffener enhancing resistance to torsion about the longitudinal axis of the sole. The torsion stiffener extends in outward direction diagonally across the sole, such that as the sole is made to roll along the longitudinal axis by the foot, the resistance to outward torsion increases. The invention also relates to a sole.

16 Claims, 5 Drawing Sheets

SHOE AND SOLE FITTED WITH TORSION STIFFENER

This invention relates to a shoe comprising a sole having a supporting surface for supporting a foot and an upper connected with the sole for locking a foot onto the supporting surface, the sole comprising an elongate torsion stiffener for enhancing resistance to torsion about the longitudinal axis of the sole.

Such a shoe is generally known and is used for protecting the foot in walking, specifically in walking over an artificially constructed, hardened flat ground.

In the known shoe, the sole is provided with an elongate torsion stiffener for enhancing resistance to torsion about the longitudinal axis of the sole. The torsion stiffener is of strip-shaped design and extends along the centerline of the sole from a part of the heel of the shoe located centrally under the heel of the foot as far as a bending line extending in use under the ball of the foot, transversely to the longitudinal axis. The torsion stiffener is so arranged that the resistance to torsion about the longitudinal axis of the sole is substantially constant along the torsion stiffener and is the same in inward and in outward direction. 'Stiffener' is a term commonly used in the art for such provisions.

In the known shoe, the sole may be provided with a correction area of slightly raised design for correcting the position of the foot while being supported on the sole, such that at the correction area the distance between the supporting surface and a tread surface of the sole is greater. The correction area is located under the curved arched part of the inner foot, such that sagging of the arched part of the foot is prevented.

During walking, the foot rolls over the sole from the heel via the middle foot through to the toes. The sole of the shoe on which the sole is supported thereby rolls likewise from a heel part located adjacent the heel of the foot over the tread surface in the direction of the longitudinal axis of the sole, through to a tip portion of the sole, located beyond the toes.

A disadvantage of the known shoe is that both during standstill and during walking, the shoe forces the foot to assume an unfavorable position. In particular, the outer margin of the foot, during standstill, is located relatively low, and during walking the foot rolls along the outer margin. As a result, during the rolling movement of the foot, there is an increasing tendency for the foot to twist outwards. The tendency to twist outwards is present in particular during the second part of the rolling movement, i.e., during and following the rolling movement of the middle foot. To correct this unfavorable position, a human will try, both when standing still and when walking, to correct the position of the foot by means of his muscles.

Not only does such correction take a relatively large amount of energy, it also entails a relatively heavy loading of the muscles and the joints. In particular in humans who use their feet intensively, such as sportsmen, this may give rise to injuries and/or adversely affect running performance. In addition, in older people, walking may be rendered more difficult due to a lack of corrective muscular strength or due to pain in the joints owing to the unfavorable position of the foot.

The object of the invention is to provide a shoe of the type mentioned in the opening paragraph hereof, in which the above-mentioned disadvantages are avoided. To that end, the shoe according to the invention is characterized in that the torsion stiffener extends in outward direction diagonally across the sole, such that as the sole is made to roll along the longitudinal axis by the foot, the resistance to outward torsion increases. What is thereby achieved is that the outward twisting of the foot, in particular during the second part of the rolling movement, can be prevented by means of the torsion stiffener, so that during walking the muscles, as far as correction is concerned, can be further relieved, and the above-mentioned advantages can be further enhanced.

Not only can the risk of injuries in sportsmen be reduced in this way, but also the running performance can be enhanced in that more energy is made available for the forward running movement. In older people, less muscular strength is needed for walking, so that walking can be facilitated. What can moreover be achieved is that due to the foot being better supported during its rolling movement, incorrect loading of the joints is prevented, which reduces the risk of pain in the joints and wear of joints. In particular in older people, this can facilitate walking.

In an advantageous embodiment, a shoe according to the invention is characterized in that the sole is provided with a correction area of slightly raised design for correcting the position of the foot while being supported on the sole, such that at the correction area the distance between the supporting surface and the tread surface of the sole is greater, the correction area comprising a first correction subarea, located on the inner side of the sole, which corresponds with the sustentaculum tali and the navicular bone of the foot, and a second correction subarea, located on the outer side, which corresponds with the outer margin of the foot adjacent the outermost metatarsals and phalanges of the foot. What is thus achieved is that the a foot, when standing still and during walking, can be brought into a more neutral position, i.e., more into a position the foot would assume when standing still and in walking on soft ground. In particular, by means of the first correction subarea adjacent the sustentaculum tali and the navicular bone inward torsion about the longitudinal axis of the foot is prevented, while by means of the second correction subarea adjacent the outermost metatarsals and innermost phalanges adjacent the margin of the foot outward torsion about the longitudinal axis of the foot is prevented. This can prevent the occurrence of torsion of the foot relative to the longitudinal axis, so that the muscles can be further relieved not only during walking but also when standing still.

By providing the sole adjacent the supporting area of the cuneiform bone and the metatarsals on the inner side (medial side) of the foot with a lowered area where the distance between the supporting surface and the tread surface of the sole is normal, or at least reduced relative to the first correction subarea, it is accomplished that the occurrence of torsion can be further prevented, and the neutral position can be approximated more closely.

Further advantageous embodiments of the invention are set forth in the subclaims.

It is noted that in this context, 'outward' is understood to mean the direction extending during walking in forward direction of the sole from the inner side of the foot located on the side of the foot arch to the outer side located on the opposite side at the outer margin of the foot, i.e., when oriented in the walking direction, for the right sole to the right and clockwise relative to the longitudinal axis, and for the left sole to the left and counterclockwise, respectively, while 'inward' is to be understood to mean the obverse mutatis mutandis.

The invention will be further explained on the basis of an exemplary embodiment which is represented in the drawings. In the drawings.

The figures are only schematic representations of preferred embodiments. In the figures, the same or corresponding parts are designated by the same reference numerals.

Figure 1:
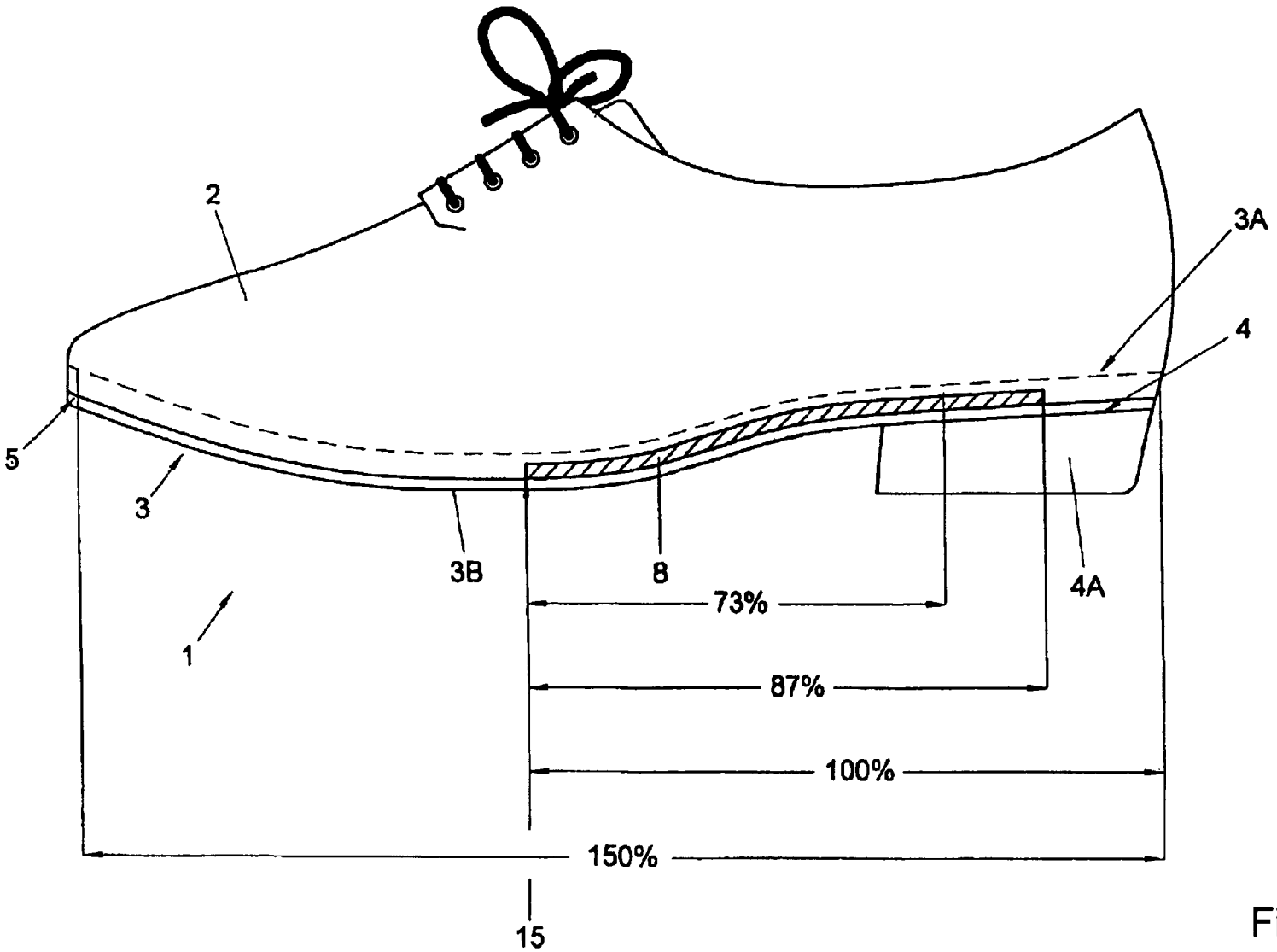
FIG. 1 is a side elevation of a right shoe according to the invention.
Figure 2:
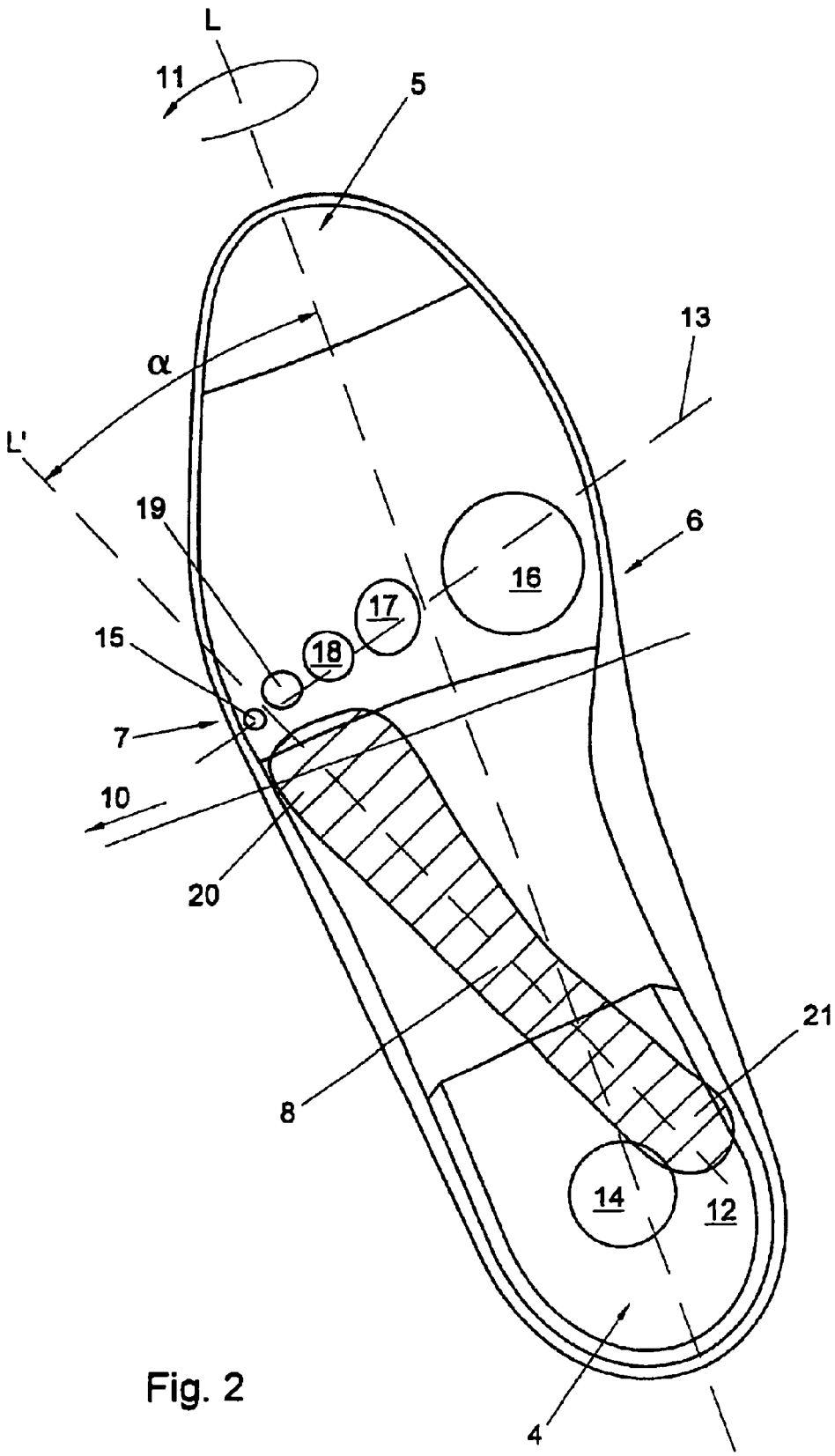
FIG. 2 is a bottom plan view of the shoe of FIG. 1.

Referring to FIGS. 1 and 2, there are shown a shoe 1 with an upper 2 and a sole 3. The sole 3 extends along a longitudinal axis L, from a heel 4 in use located adjacent the heel of the foot, to a tip 5 in use located forward of the toes or phalanges. In the figures, a right shoe 1 is represented, of which the medial or inner side 6 of the sole in use corresponds with the foot arch, and the lateral or outer side 7 in use corresponds with the outer margin of the foot.

The sole 3 is made up of an insole 3A, on which the foot stands, and an outsole 3B, which forms the lower part of the shoe 1 and which, at standstill, is placed on the a ground and of which a tread surface rolls along the ground during walking. On the heel 4 of the outsole 3B, a raised heel portion 4A may be provided.

The insole 3A and the outsole 3B are secured to each other, for instance by means of a glued joint. Between the insole 3A and the outsole 3B, an elongate torsion stiffener 8 is arranged. The torsion stiffener B extends in outward direction, diagonally across the sole 3, so that as the sole 2 is made to roll along the longitudinal axis L by the foot, the resistance to outward torsion about the longitudinal axis increases. For the right shoe shown, the outward direction with regard to torsion about the longitudinal axis L is indicated by the arrow 11 and with regard to translation in the plane of the sole 3 by arrow 10. The longitudinal axis L' of the torsion stiffener 8 therefore encloses an acute angle $\alpha$ in the plane of the drawing of FIG. 2 with the longitudinal axis L of the sole 3, while the torsion stiffener 8, viewed in a forward direction from the heel 4 to the tip 5, extends from the inner side 6 to the outer side 7.

The torsion stiffener 8 preferably extends from the inner part 12 of the heel 4 adjacent the inner side 6 or the supporting area 14 of the heel bone, as far as the outer side 7 at the bending line 13 adjacent the supporting area 15 of the joint of the little toe or fifth phalanx 45. In FIG. 2 the supporting areas of the joints of the other four toes are indicated from the big or first toe to the fourth toe by the increasing reference numerals 16, 17, 18, and 19, respectively.

Viewed anatomically from a person, the torsion stiffener 8 extends diagonally forwards and outwards from the proximal medial side (the near inside) of the sole to the distal lateral side (the remote outer side) of the sole. In use, the torsion stiffener 8 extends between the part of the sole located adjacent the inner side, which corresponds with the area between the sustentaculum tali and the navicular bone of the foot, and the part of the sole located adjacent the outer side, which corresponds with the area between the fifth metatarsal and the fifth phalanx of the foot.

The torsion stiffener is of sheetlike design and is slightly widened at the ends 20 and 21. In FIG. 1 it is visible that the torsion stiffener 8 has a slightly bent downward configuration from the raised heel part 4A.

The torsion stiffener 8 can be designed as a single strip of, for instance, metal or plastic, but can also be designed as a sandwich construction.

Preferably, the torsion stiffener has a length of about 80–95%, more preferably about 85–90%, in particular about 87%, of the distance from the rear edge of the heel 4 to the bending line 13 of the sole 2, measured along the longitudinal axis L.

Figure 3:
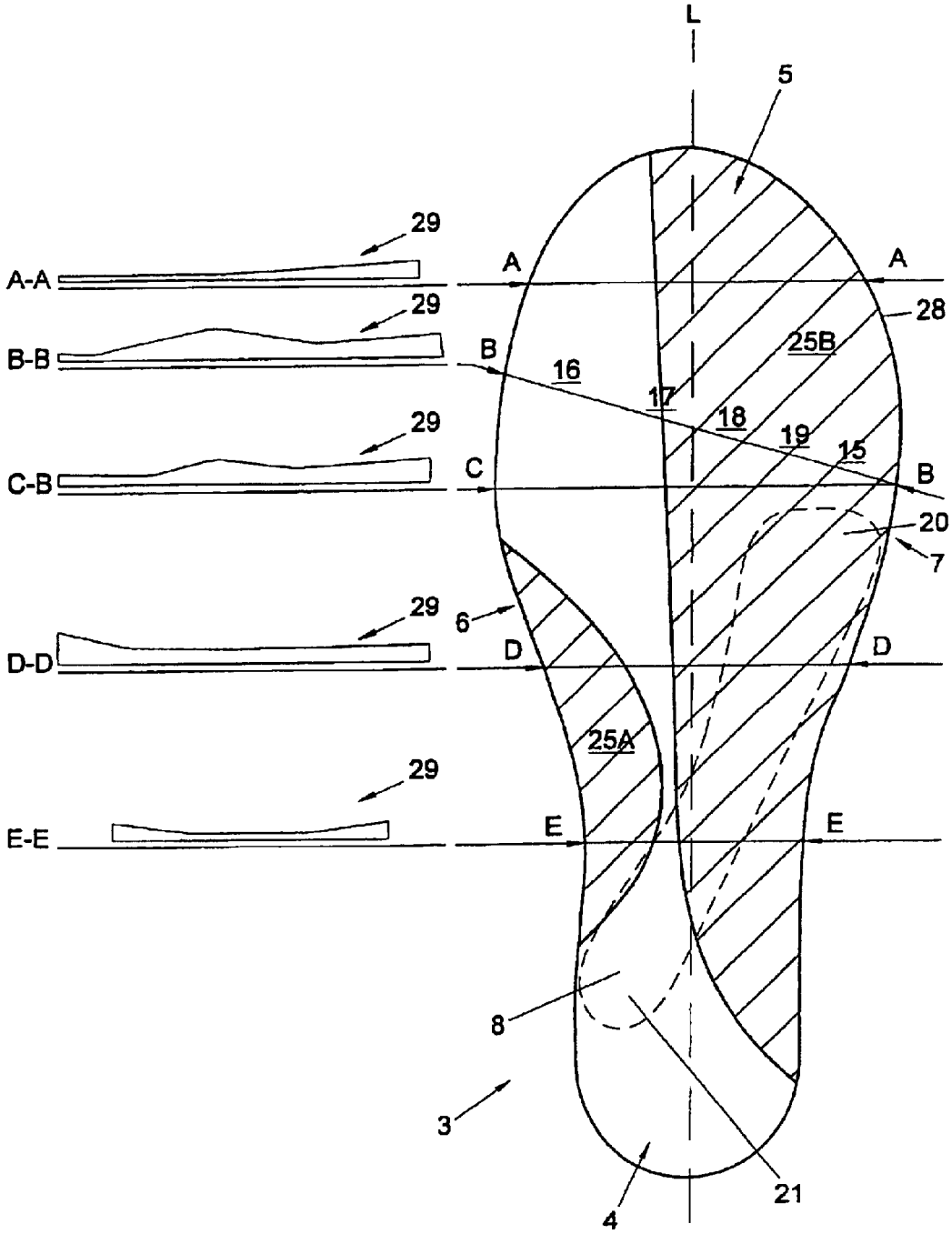
FIG. 3 is a top plan view of the sole of the shoe of FIG. 1, in which the torsion stiffener and the corrective subareas are shown.

Referring to FIG. 3, there is indicated that the sole is provided with correction areas 25A, 25B, made of slightly raised design through thickening, for correcting the position of the foot while being supported on the sole 3, such that at a correction area the distance d between the supporting surface 26 and the tread surface 27 of the sole 3 is greater. In FIG. 3, the cross-sections A-A, B-B, C-B, D-D, and E-E represent the course of the height d in question, being thickness in this embodiment, across the cross section of the sole 3.

In cross section A-A, it can be seen that the correction area has a constantly ascending configuration from the inner side 6 to the outer side 7. In principle, cross sections B-B and C-B can have the same constantly ascending configuration, with point B being the highest point of the whole correction area 25B. It is represented in the figure, however, that a forefoot support may be arranged, intended as an additional support for the joints at the bases of the second and third phalanges. Thus, a convexity is superposed on the constantly rising configuration.

The correction area comprises a first correction subarea 25A, located on the inner side 6 of the sole 3, which corresponds with the supporting area of the sustentaculum tali 40 and the navicular bone 41 of the foot. This first correction subarea 25A is hatched in the drawing. The correction area further comprises a second correction subarea 25B, which is located on the outer side 7, and which corresponds with the supporting area of the metatarsals and the phalanges on the outer margin of the toot. The second correction subarea 25B extends along an outer edge 28 of the sole 3, located on the outer side 7 relative to the centerline L of the sole. The second correction subarea 25B extends downwards from the outer edge 28A in inward direction, indicated by the arrows 29, i.e., from the supporting surface 26 in the direction of the tread surface 27, such that at least the fifth, preferably also the fourth and/or the third phalanges and metatarsals are at least partly supported.

Figure 5:
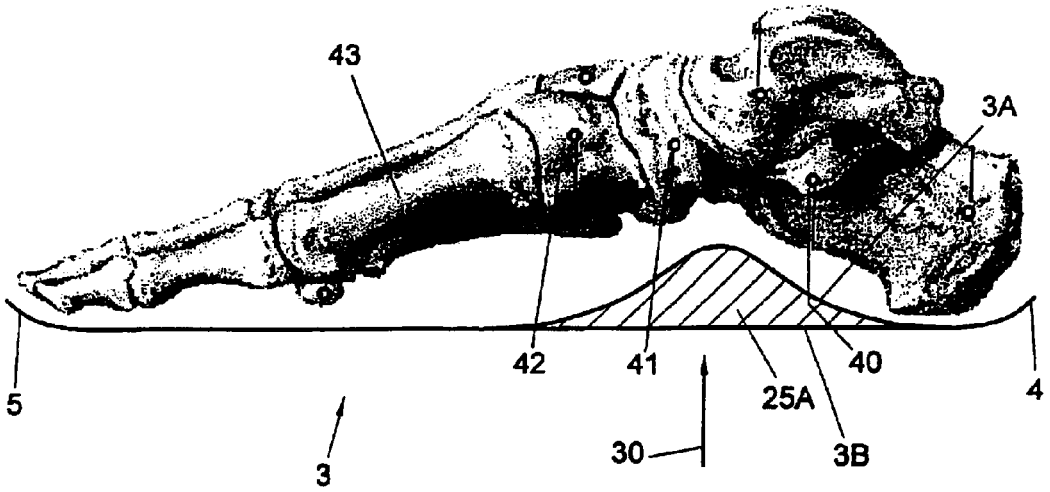
FIG. 5 shows the sole of FIG. 4 in side elevation from the interior or medial side, representing only the skeleton of the foot.

FIG. 5 shows that the first correction subarea 25A serves as a support for the sustentaculum tali 40 and the navicular bone 41, while the first correction subarea does not serve to support the cuneiform bone 42 nor supports the metatarsal 43.

Figure 4:
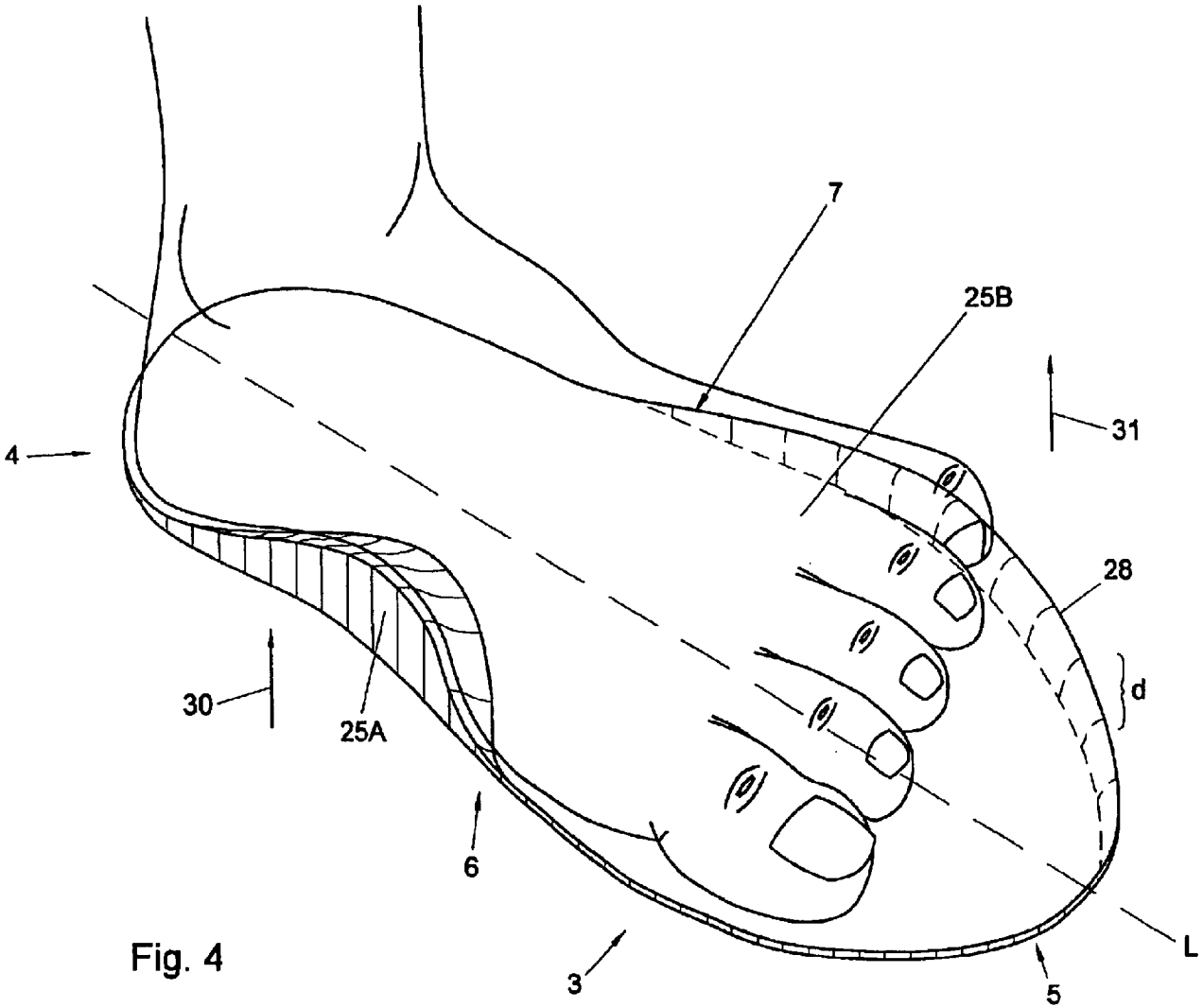
FIG. 4 shows in perspective view a left sole according to the invention on which a foot is placed.
Figure 6:
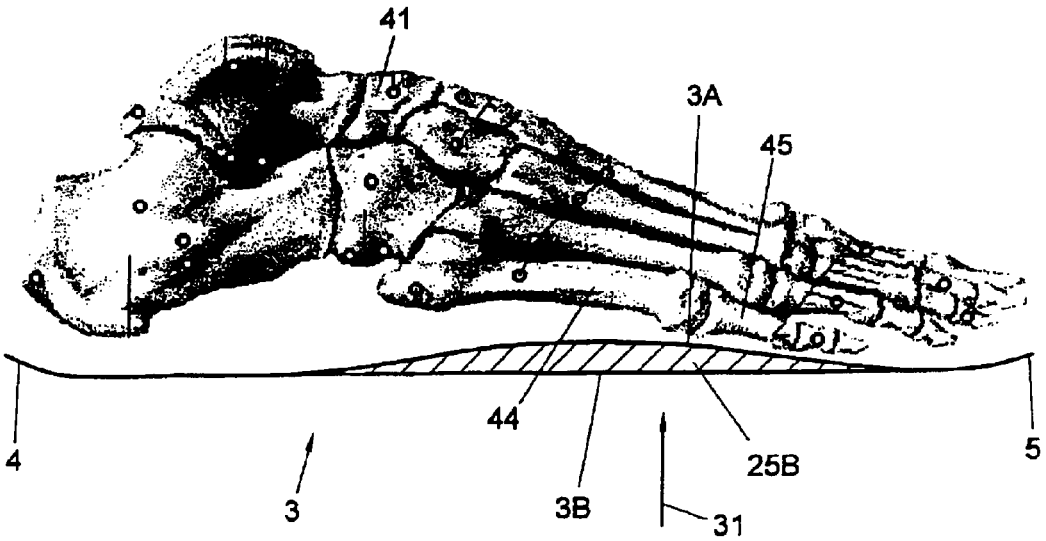
FIG. 6 shows the sole of FIG. 5, viewed from the exterior or lateral side.

On the outer edge 28, the second correction subarea 25B has its greatest height d adjacent the supporting area 15 of the joint of the little or fifth toe. This is shown inter alia in FIG. 6, where it can also be seen that the second correction area extends on the outer edge 7 under the fifth metatarsal 44 and the fifth phalanx 45. By means of the first correction subarea, adjacent the sustentaculum tali 40 and the navicular bone 41, inward torsion about the longitudinal axis of the foot is prevented, while by means of the second correction subarea adjacent the edge of the foot, outward torsion relative to the longitudinal axis of the foot is prevented. Thus, the occurrence of torsion of the foot about the longitudinal axis can be prevented, so that the muscles can be relieved, where correction is concerned, during walking and when standing still. In FIG. 4 this is represented by means of arrows 30 and 31, respectively. Viewed anatomically, the sole 3 is provided with a distal and a medial pronation. For the sake of clarity, the torsion stiffener is not represented in FIG. 4.

What is accomplished by combining the torsion stiffener extending diagonally outwards and the correction subareas for supporting the sustentaculum tali and the outer margin of the foot, is that when standing still and in walking the foot can stand in a natural position and that any deviation from the natural position due to outward twisting during the rolling movement of the foot is counteracted. It will be clear that these measures enhance each other but that these measures can also be applied separately. The sole is preferably manufactured from plastic material, for instance by means of a material-removing operation. Of course, other manufacturing methods, such as molding or thermoforming, are also possible. The sole can further be manufactured from other material, for instance wood, metal or combinations of various materials. Preferably, the sole, when intended for a healthy foot, has a hardness corresponding to that of shoe leather. The sole may be composed of parts, but may also be manufactured in one piece.

The invention also relates to a sole for use in a shoe. This is understood to include a support sole to be placed (as a loose part) in a shoe, for instance a support extending from the heel of the shoe to the supporting area of the toe joints.

It is noted that the invention is not limited to the exemplary embodiment discussed here, but that a great number of variations are possible. Thus, the torsion stiffener can have, at least locally, a cylindrical, oval or rectangular cross section, and the torsion stiffener may further comprise a number of parts extending substantially parallel. Further, the torsion stiffener can be made of widened design at one end only, or the torsion stiffener, viewed in longitudinal direction, may be of equal width throughout, or vary in width at different points. Also, the thickness of the torsion stiffener may vary, for instance so as to increase or decrease along the longitudinal axis. Furthermore, the sole can be built up from more or fewer layers, and the torsion stiffener can be incorporated directly into the sole, for instance by clamped fitting or insert molding, and the torsion stiffener can be connected with the sole through an intermediate part, or be clamped onto it. Additionally, the sole can comprise a bent sheetlike part of substantially equal thickness, which may or may not be provided with supporting material.

Such variations will be clear to those skilled in the art and are understood to fall within the framework of the invention as set forth in the following claims.

What is claimed is:

1. A shoe comprising:

a sole having a supporting surface for supporting a foot;

an upper connected with the sole for locking the foot onto the supporting surface;

the sole further comprising a strip-shaped, elongate torsion stiffener for enhancing resistance to torsion about the longitudinal axis of the sole, characterized in that the torsion stiffener extends diagonally forwards and outward across the sole from the proximal medial side of the sole to the distal lateral side of the sole such that the torsion stiffener extends along a first longitudinal axis and said sole extends along a second longitudinal axis wherein the fist longitudinal axis forms an acute angle with the second longitudinal axis, whereby as the sole is made to roll along the longitudinal axis by the foot, the resistance to torsion increases; and wherein the torsion stiffener is substantially in the form of a sheet.

2. A shoe according to claim 1, wherein the torsion stiffener further comprises a first end and a second end and the torsion stiffener is widened adjacent at least on of the ends.

3. A shoe according to claim 1; wherein the torsion stiffener extends from the inner side of the heel of the shoe as far as an outer side adjacent a supporting area of the sole supporting a joint at the base of the little toe of the foot.

4. A shoe according to claim 1, wherein the torsion stiffener extends between a first part of the sole located adjacent to an inner side, which corresponds to an area of the foot between the sustentaculum tali and the navicular bone, and a second part of the sole located adjacent an outer side, which corresponds to an area of the foot between the fifth metatarsal and the fifth phalanx.

5. A shoe according to claim 1, wherein the sole is provided with a slightly raised correction area for correcting the position of the foot while being supported on the sole, whereby at the correction area, the distance between the supporting surface and a tread surface of the sole is greater, the correction area comprising:

a first correction subarea located on an inner side of the sole, which corresponds with an area supporting the sustentaculum tall and the navicular bone of the foot; and a second correction subarea located on an outer side of the sole, which corresponds with an area supporting the outer margin of the foot adjacent at least a part of the outermost metatarsals and outermost phalanges of the foot.

6. A shoe according to claim 5, wherein the second correction subarea extends along an outer edge of the sole located on the outer side relative to the centerline of the sole.

7. A shoe according to claim 5, wherein the second correction subarea extends downwards from an outer edge of the sole in an inward direction.

8. A shoe according to claim 5, wherein an outer edge of the second correction subarea has a greatest height at the outer margin of the foot adjacent the area corresponding to the joint at the base of the little toe of the foot.

9. A sole for supporting a foot, comprising a strip-shaped, elongate torsion stiffener for enhancing resistance to torsion about a longitudinal axis of the sole, characterized in that the torsion stiffener extends diagonally forwards and outwards across the sole from a proximal medial side of the sole to a distal lateral side of the sole, such that the torsion stiffener extends along a first longitudinal axis and said sole extends along a second longitudinal axis wherein the first longitudinal axis forms an acute angle with the second longitudinal axis, whereby as the sole is made to roll along the longitudinal axis by the foot, the resistance to torsion increases and wherein the torsion stiffener is substantially in the form of a sheet.

10. A sole according to claim 9, wherein the torsion stiffener further comprises a first end and a second end and the torsion stiffener is widened adjacent at least one of the ends.

11. A sole according to claim 9, wherein the torsion stiffener extends from an inner side of the heel of a shoe as far as an outer side adjacent a supporting area of the sole supporting a joint of the little toe of the foot.

12. A sole according to claim 9, wherein the torsion stiffener extends between a first part of the sole located adjacent to an inner side, which corresponds to an area between the sustentaculum tali and the navicular bone, and a second part of the sole located adjacent an outer side, which corresponds to an area between the fifth metatarsal and the fifth phalanx.

13. A sole according to claim 9, comprising a supporting surface for supporting the foot, said supporting surface comprising a slightly raised correction area for optimizing the position of the foot while being supported on the sole, whereby at the correction area, the distance between the supporting surface and a tread surface of the sole is greater, the correction area comprising:

a first correction subarea located on the inner side of the sole, which corresponds with an area supporting the sustentaculum tali and the navicular bone of the foot; and a second correction subarea located on the outer side, which corresponds with an area supporting the outer margin of the foot adjacent at least a part of the outermost metatarsals and the outermost phalanges of the foot.

14. A sole according to claim 13, wherein the second correction subarea extends along an outer edge of the sole located on the outer side relative to the centerline of the sole.

15. A sole according to claim 13, wherein the second correction subarea extends downwards from an outer edge of the sole in an inward direction.

16. A sole according to claim 13, wherein the outer edge of the second correction subarea has a greatest height adjacent the area corresponding to the joint at the base of the little toe of the foot.

* * * * *